US011402766B2

(12) United States Patent
Carpenter et al.

(10) Patent No.: US 11,402,766 B2
(45) Date of Patent: Aug. 2, 2022

(54) TONER CARTRIDGE ELECTRICAL CONTACTS

(71) Applicant: LEXMARK INTERNATIONAL, INC., Lexington, KY (US)

(72) Inventors: Brian Scott Carpenter, Lexington, KY (US); Gregory Alan Cavill, Winchester, KY (US); Jeffrey Lawrence Tonges, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/108,465

(22) Filed: Dec. 1, 2020

(65) Prior Publication Data

US 2021/0080865 A1 Mar. 18, 2021

Related U.S. Application Data

(63) Continuation of application No. 16/405,100, filed on May 7, 2019, now Pat. No. 10,884,353.

(51) Int. Cl.
*G03G 15/08* (2006.01)
*G03G 21/16* (2006.01)

(52) U.S. Cl.
CPC ..... *G03G 15/0865* (2013.01); *G03G 21/1647* (2013.01); *G03G 21/1652* (2013.01)

(58) Field of Classification Search
CPC ..... G03G 15/0865; G03G 21/1647; G03G 21/1652; G03G 21/1821; G03G 21/1867; G03G 15/80; G03G 15/0875
See application file for complete search history.

(56) References Cited

U.S. PATENT DOCUMENTS

| | | | | |
|---|---|---|---|---|
| 5,873,012 | A | 2/1999 | Miyabe et al. | |
| 2015/0139698 | A1* | 5/2015 | Leemhuis | G03G 15/0865 399/258 |
| 2017/0075294 | A1* | 3/2017 | Payne | G03G 15/0877 |
| 2017/0205762 | A1* | 7/2017 | Amann | G03G 15/80 |
| 2017/0315496 | A1* | 11/2017 | Carpenter | G03G 21/1867 |

* cited by examiner

*Primary Examiner* — Jessica L Eley
(74) *Attorney, Agent, or Firm* — Justin M. Tromp

(57) ABSTRACT

A toner cartridge according to one example embodiment includes a reservoir for holding toner. An outlet is positioned on a front of the toner cartridge for exiting toner from the toner cartridge. First, second and third electrical contacts are positioned on a first side of the toner cartridge for contacting corresponding first, second and third electrical contacts in an image forming device. Each of the first, second and third electrical contacts of the toner cartridge is electrically connected to a respective imaging component positioned on the toner cartridge. The first, second and third electrical contacts of the toner cartridge are positioned such that an imaginary line that angles downward in a direction from a rear of the toner cartridge toward the front of the toner cartridge passes through the first, second and third electrical contacts of the toner cartridge.

13 Claims, 8 Drawing Sheets

TONER CARTRIDGE ELECTRICAL CONTACTS

CROSS REFERENCES TO RELATED APPLICATIONS

This application is a continuation application of U.S. patent application Ser. No. 16/405,100, filed May 7, 2019, entitled "Toner Cartridge Electrical Contacts."

BACKGROUND

1. Field of the Disclosure

The present disclosure relates generally to image forming devices and more particularly to toner cartridge electrical contacts.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device typically includes one or more replaceable units that have a shorter lifespan than the image forming device. For example, the image forming device's toner supply may be stored in a replaceable unit. A separate replaceable unit may include one or more imaging components having a relatively longer life than the toner supply. Each replaceable unit may require various electrical connections to the image forming device upon installation of the replaceable unit in the image forming device. For example, the replaceable unit(s) may include imaging components, such as a developer roll, a toner adder roll, a doctor blade, a photoconductive drum, a charge roll, etc., that are electrically charged to a specified voltage by a power supply in the image forming device when the replaceable unit is installed in the image forming device in order to electrostatically move toner from one component to another. The replaceable unit(s) may include one or more electrical contacts that mate with corresponding electrical contacts in the image forming device upon installation of the replaceable unit in the image forming device in order to provide an electrical connection between the power supply of the image forming device and the imaging components of the replaceable unit.

It is important for the electrical contacts of the replaceable unit(s) to consistently and reliably contact the corresponding electrical contacts in the image forming device upon installation of the replaceable unit in the image forming device in order to ensure a reliable electrical connection for proper operation.

SUMMARY

A toner cartridge for use in an image forming device according to one example embodiment includes a housing having a top, a bottom, a front and a rear positioned between a first side and a second side of the housing. The housing has a reservoir for holding toner. A developer roll is rotatably positioned on the housing. A portion of an outer surface of the developer roll is exposed along the front of the housing for supplying toner from the reservoir to a corresponding photoconductive drum. An interface gear on the first side of the housing is rotatably coupled to the developer roll. At least a portion of the interface gear is exposed at the front of the housing for mating with a corresponding drive gear and receiving rotational force from the corresponding drive gear. A first alignment guide extends outward from the first side of the housing and a second alignment guide extends outward from the second side of the housing for positioning the toner cartridge. A first electrical contact is positioned on the second side of the housing for contacting a first corresponding electrical contact in the image forming device. The first electrical contact of the toner cartridge is electrically connected to processing circuitry mounted on the housing. A second electrical contact is positioned on the second side of the housing for contacting a second corresponding electrical contact in the image forming device. The second electrical contact of the toner cartridge is electrically connected to the developer roll. The second electrical contact of the toner cartridge is positioned higher than the developer roll and the interface gear and is positioned closer to the rear of the housing than the developer roll and the interface gear are to the rear of the housing. The second electrical contact of the toner cartridge is positioned higher than the first and second alignment guides and is positioned closer to the rear of the housing than the first and second alignment guides are to the rear of the housing. The second electrical contact of the toner cartridge is positioned higher than the first electrical contact of the toner cartridge. In some embodiments, the second electrical contact of the toner cartridge is positioned closer to the front of the housing than the first electrical contact of the toner cartridge is to the front of the housing.

Embodiments include those wherein the second electrical contact of the toner cartridge faces outward sideways away from the second side of the housing.

Embodiments include those wherein the second electrical contact is positioned on a projection that projects outward sideways from the second side of the housing. The projection extends further outward sideways than an outer side surface of the second side of the housing that is positioned below the projection and that extends from the front of the housing to the rear of the housing.

Some embodiments include a rotatable toner agitator positioned in a central portion of the reservoir and rotatably coupled to the interface gear. The second electrical contact is positioned higher than a rotational axis of the toner agitator and is positioned closer to the front of the housing than the rotational axis of the toner agitator is to the front of the housing.

A toner cartridge for use in an image forming device according to another example embodiment includes a housing having a top, a bottom, a front and a rear positioned between a first side and a second side of the housing. The housing has a reservoir for holding toner. An outlet in fluid communication with the reservoir is positioned on the front of the housing for exiting toner from the toner cartridge. A first electrical contact, a second electrical contact and a third electrical contact are positioned on the first side of the housing for contacting a first corresponding electrical contact in the image forming device, a second corresponding electrical contact in the image forming device and a third corresponding electrical contact in the image forming device. Each of the first, second and third electrical contacts of the toner cartridge is electrically connected to a respective imaging component positioned on the housing.

In some embodiments, the first, second and third electrical contacts of the toner cartridge are positioned such that an imaginary line that angles downward in a direction from the rear of the housing toward the front of the housing passes through the first, second and third electrical contacts of the toner cartridge.

In some embodiments, at least a portion of the first electrical contact of the toner cartridge is positioned higher than the second electrical contact of the toner cartridge and closer to the rear of the housing than the second electrical contact of the toner cartridge is to the rear of the housing. At least a portion of the second electrical contact of the toner cartridge is positioned lower than the first electrical contact of the toner cartridge and closer to the front of the housing than the first electrical contact of the toner cartridge is to the front of the housing. At least a portion of the second electrical contact of the toner cartridge: is positioned higher than the third electrical contact of the toner cartridge and closer to the rear of the housing than the third electrical contact of the toner cartridge is to the rear of the housing. At least a portion of the third electrical contact of the toner cartridge is positioned lower than the second electrical contact of the toner cartridge and closer to the front of the housing than the second electrical contact of the toner cartridge is to the front of the housing.

Embodiments include those wherein each of the first, second and third electrical contacts of the toner cartridge face outward sideways away from the first side of the housing.

Embodiments include those wherein each of the first, second and third electrical contacts of the toner cartridge is positioned on a projection that projects outward sideways from the first side of the housing. The projection extends further outward sideways than an outer side surface of the first side of the housing that is positioned below the projection and that extends from the front of the housing to the rear of the housing.

Some embodiments include a developer roll rotatably positioned on the housing. The outlet includes a portion of an outer surface of the developer roll exposed along the front of the housing for supplying toner from the reservoir to a corresponding photoconductive drum. One of the first, second and third electrical contacts of the toner cartridge is electrically connected to the developer roll. In some embodiments, at least a portion of each of the first, second and third electrical contacts of the toner cartridge is positioned higher than the developer roll and is positioned closer to the rear of the housing than the developer roll is to the rear of the housing.

Some embodiments include a first alignment guide extending outward from the first side of the housing and a second alignment guide extending outward from the second side of the housing for positioning the toner cartridge. At least a portion of each of the first, second and third electrical contacts is positioned higher than the first and second alignment guides and is positioned closer to the rear of the housing than the first and second alignment guides are to the rear of the housing.

Some embodiments include a fourth electrical contact on the first side of the housing for contacting a fourth corresponding electrical contact in the image forming device. The fourth electrical contact of the toner cartridge is electrically connected to processing circuitry mounted on the housing. At least a portion of each of the first, second and third electrical contacts of the toner cartridge is positioned higher than the fourth electrical contact of the toner cartridge and is positioned closer to the front of the housing than the fourth electrical contact of the toner cartridge is to the front of the housing.

A toner cartridge for use in an image forming device according to another example embodiment includes a housing having a top, a bottom, a front and a rear positioned between a first side and a second side of the housing. The housing has a reservoir for holding toner. An outlet in fluid communication with the reservoir is positioned on the front of the housing for exiting toner from the toner cartridge. A first electrical contact is positioned on the first side of the housing for contacting a first corresponding electrical contact in the image forming device. The first electrical contact of the toner cartridge is electrically connected to an imaging component positioned on the housing. The first electrical contact is positioned on a projection that projects outward sideways from the first side of the housing. The projection extends further outward sideways than an outer side surface of the first side of the housing that is positioned below the projection and that extends from the front of the housing to the rear of the housing.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
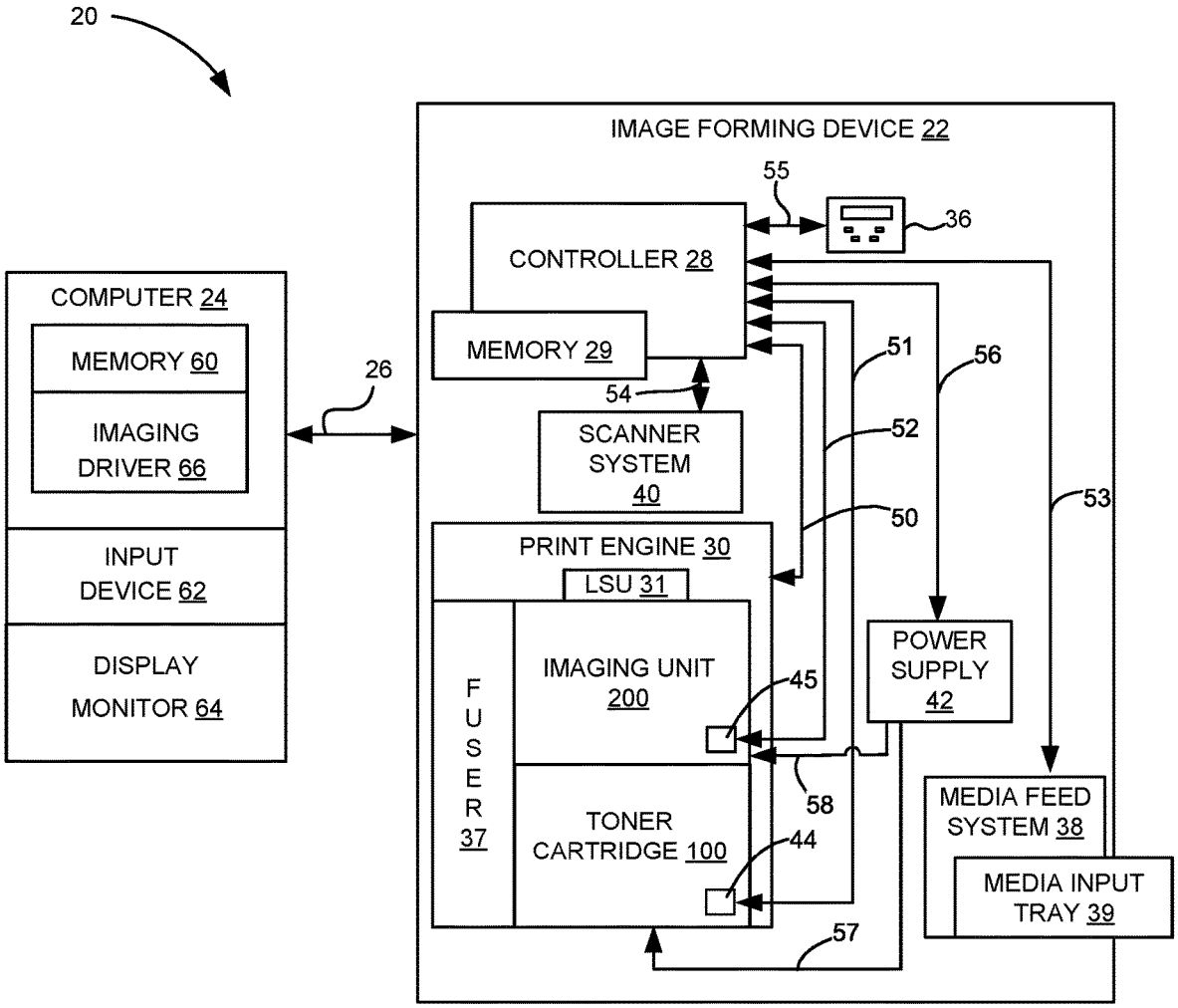
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, an imaging unit 200, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with imaging unit 200 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Controller 28 communicates with power supply 42 via a communications link 56. Controller 28 processes print and scan data and operates print engine 30 during printing and scanner system 40 during scanning. Processing circuitry 44, 45 may provide authentication functions, safety and operational interlocks, operating parameters and usage information related to toner cartridge 100 and imaging unit 200, respectively. Each of processing circuitry 44, 45 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44, 45.

Computer 24, which is optional, may be; for example, a personal computer, including electronic memory 60, such as RAM, ROM, and/or NVRAM, an input device 62, such as a keyboard and/or a mouse, and a display monitor 64. Computer 24 also includes a processor, input/output WO) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode; image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and a fuser 37, all mounted within image forming device 22. Toner cartridge 100 and imaging unit 200 are removably mounted in image forming device 22. Power supply 42 provides an electrical voltage to various components of toner cartridge 100 and imaging unit 200 via respective electrical paths 57 and 58. In one embodiment, toner cartridge 100 includes a developer unit that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. In another embodiment, the toner development system utilizes what is commonly referred to as a dual component development system. In this embodiment, toner in the toner reservoir of the developer unit is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, the developer unit includes a developer roll that attracts the magnetic carrier beads having toner thereon to the developer roll through the use of magnetic fields. In one embodiment, imaging unit 200 includes a photoconductor unit that houses a charge roll, a photoconductive drum and a waste toner removal system. Although the example image forming device 22 illustrated in FIG. 1 includes one toner cartridge and imaging unit, in the case of an image forming device configured to print in color, separate toner cartridges and imaging units may be used for each toner color. For example, in one embodiment, the image forming device includes four toner cartridges, each containing a particular toner color (e.g., black, cyan, yellow and magenta) to permit color printing, and four corresponding imaging units.

The electrophotographic printing process is well known in the art and, therefore, is described briefly herein. During a printing operation, laser scan unit 31 creates a latent image on the photoconductive drum in imaging unit 200, Toner is transferred from the toner reservoir in toner cartridge 100 to the latent image on the photoconductive drum by the developer roll to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
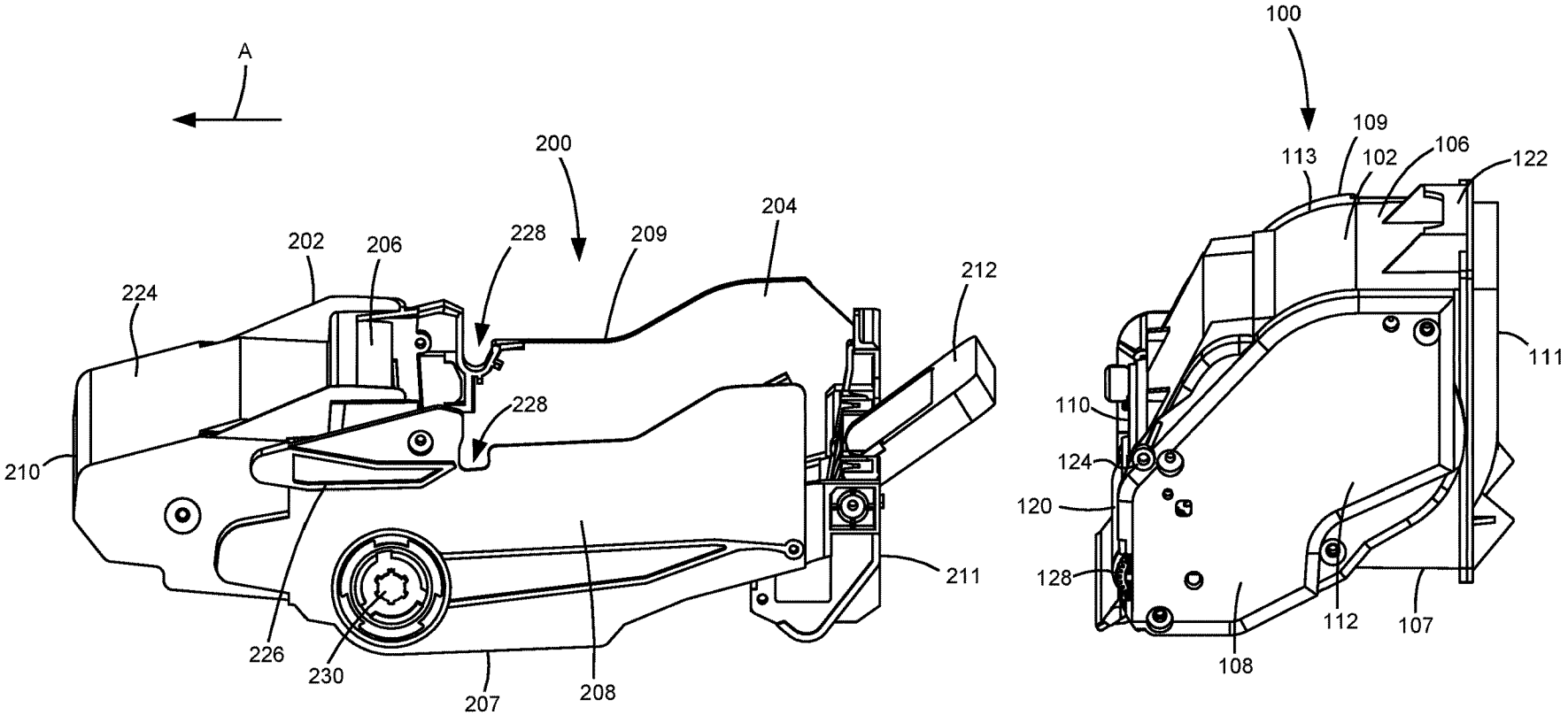
FIG. 2 is a perspective view of a toner cartridge and an imaging unit separated from each other according to one example embodiment.
Figure 3:
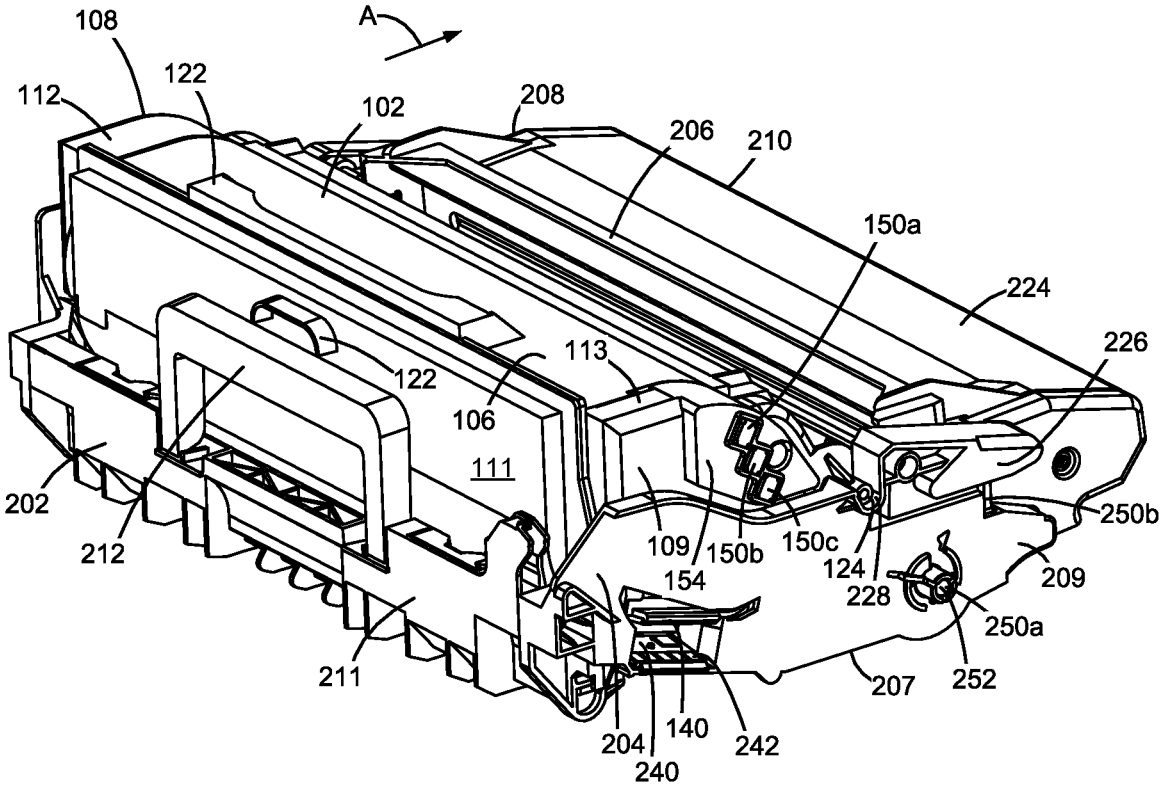
FIG. 3 is a perspective view of the toner cartridge and the imaging unit shown in FIG. 2 mated with each other according to one example embodiment.
Figure 4:
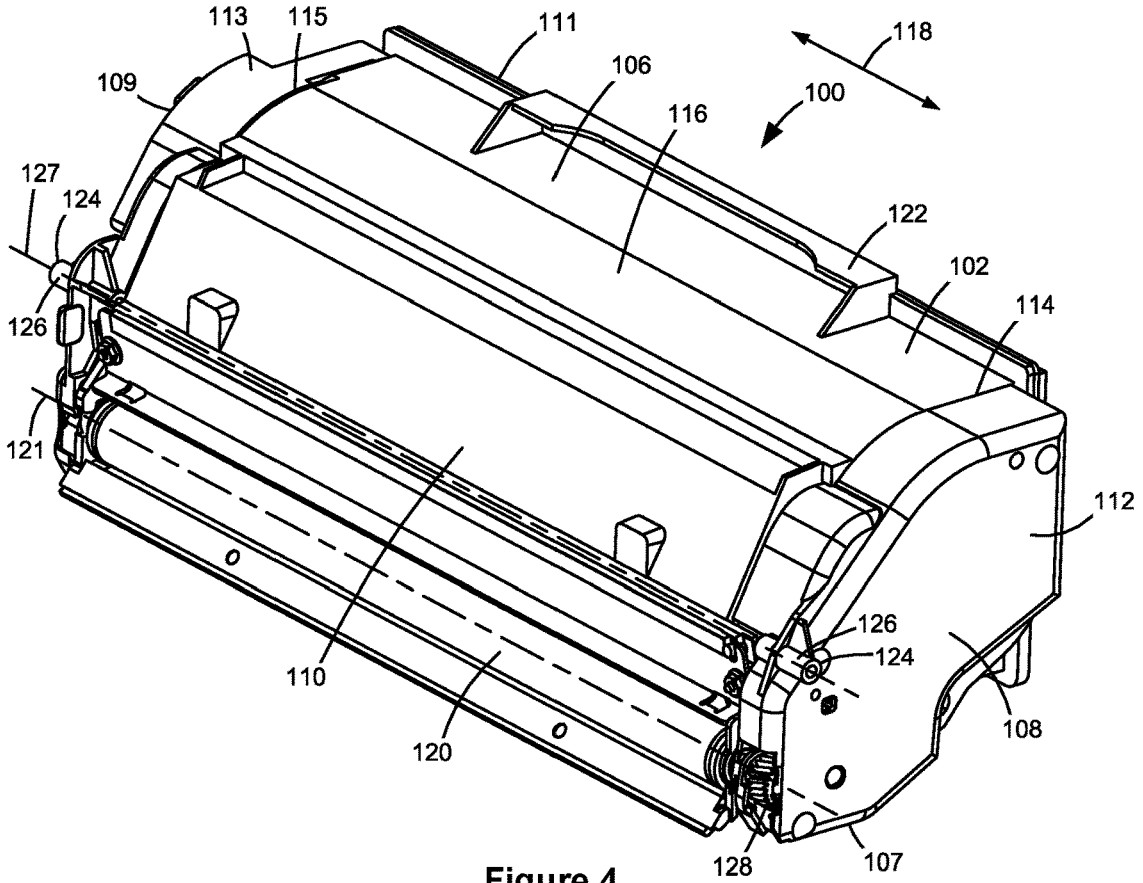
FIG. 4 is a front perspective view of the toner cartridge shown in FIGS. 2 and 3.
Figure 5:
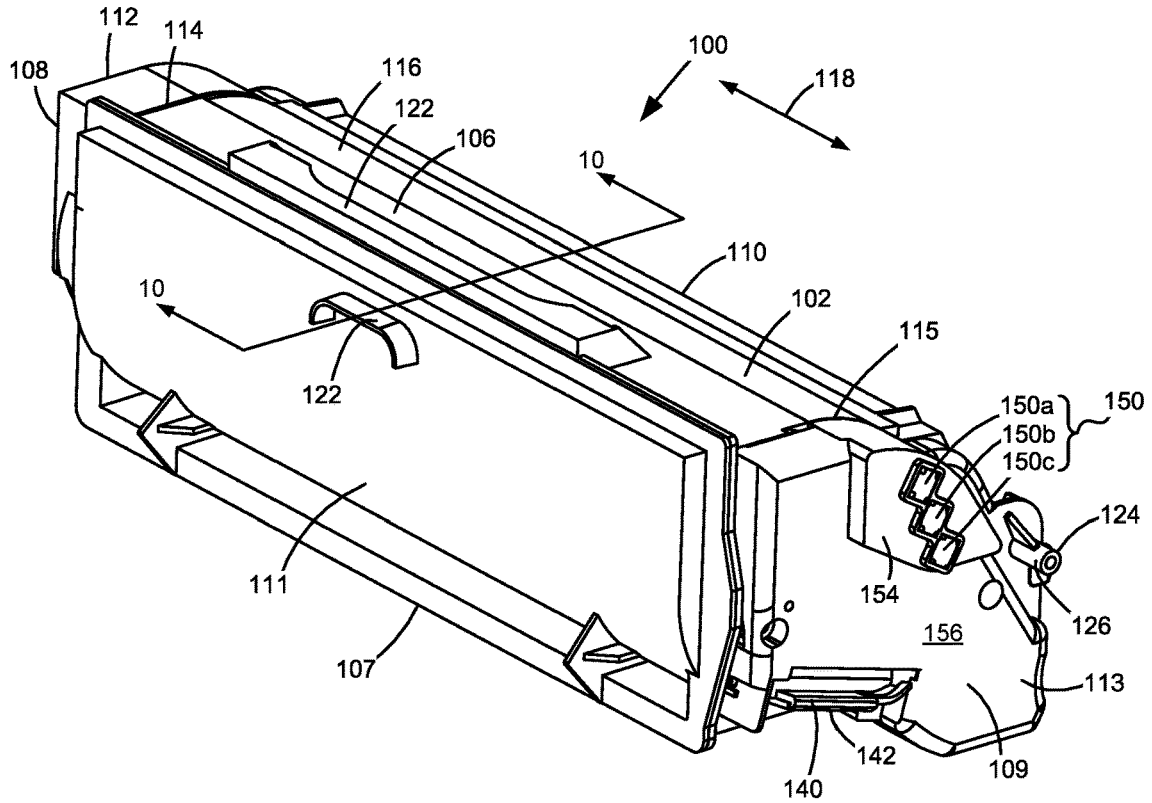
FIG. 5 is a rear perspective view of the toner cartridge shown in FIGS. 2-4.
Figure 6:
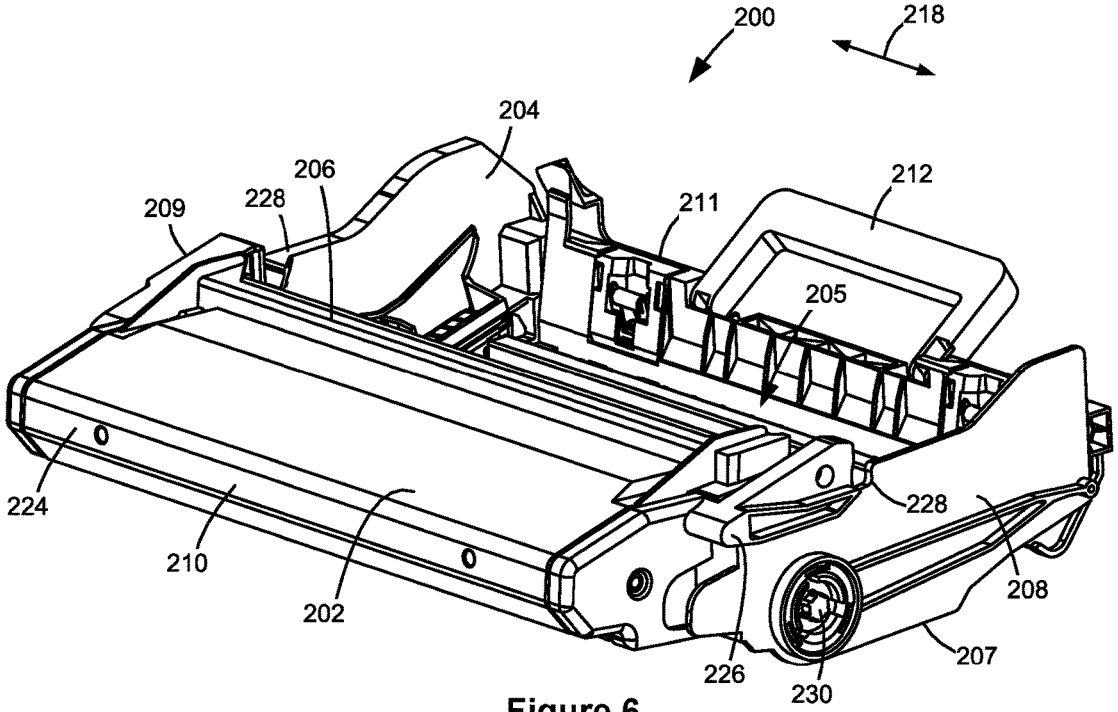
FIG. 6 is a front perspective view of the imaging unit shown in FIGS. 2 and 3.
Figure 7:
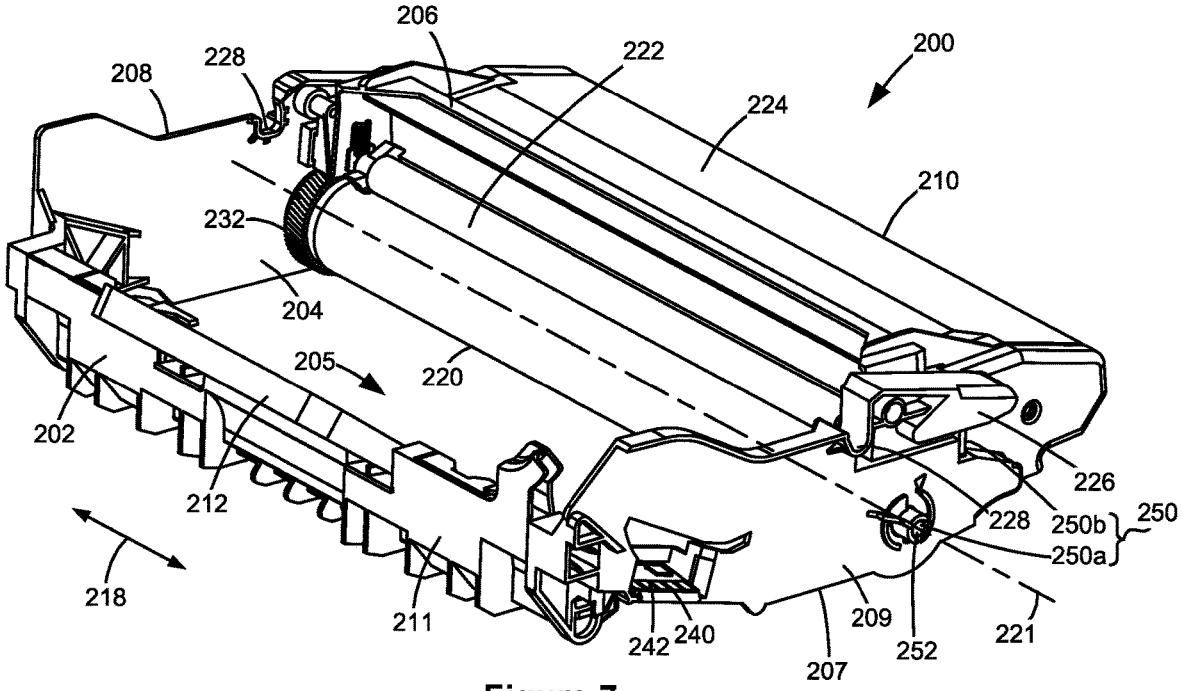
FIG. 7 is a rear perspective view of the imaging unit shown in FIGS. 2, 3 and 6.

Referring now to FIGS. 2 and 3, toner cartridge 100 and imaging unit 200 are shown according to one example embodiment. As discussed above, toner cartridge 100 and imaging unit 200 are each removably installed in image forming device 22. Toner cartridge 100 is first installed on a frame 204 of imaging unit 200 and mated with imaging unit 200, Toner cartridge 100 and imaging unit 200 are then slidably inserted together into image forming device 22. FIG. 2 shows toner cartridge 100 and imaging unit 200 separated from each other and FIG. 3 shows toner cartridge 100 installed on imaging unit 200. The arrow A shown in FIGS. 2 and 3 indicates the direction of insertion of toner cartridge 100 and imaging unit 200 into image forming device 22. This arrangement allows toner cartridge 100 and imaging unit 200 to be easily removed from and reinstalled in image forming device 22 as a single unit, while permitting toner cartridge 100 and imaging unit 200 to be repaired or replaced separately from each other.

With reference to FIGS. 2-5, toner cartridge 100 includes a housing 102 having an enclosed reservoir 104 (FIG. 10) for storing toner. Housing 102 includes a top 106, a bottom 107, first and second sides 108, 109, a front 110 and a rear 111. Front 110 of housing 102 leads during insertion of toner cartridge 100 into image forming device 22 and rear 111 trails. In one embodiment, each side 108, 109 of housing 102 includes an end cap 112, 113 mounted, e.g., by fasteners or a snap-fit engagement, to side walls 114, 115 of a main body 116 of housing 102. In the example embodiment illustrated, toner cartridge 100 includes a rotatable developer roll 120 having a rotational axis 121 that runs along a side-to-side dimension 118 of housing 102, from side 108 to side 109. A portion of developer roll 120 is exposed from housing 102 along front 110 of housing 102, near bottom 107 of housing 102 for delivering toner from toner cartridge 100 to a corresponding photoconductive drum of imaging unit 200. In this manner, developer roll 120 forms an outlet for exiting toner from toner cartridge 100. A handle 122 may be provided on top 106 or rear 111 of housing 102 to assist with coupling and decoupling toner cartridge 100 to and from imaging unit 200 and insertion and removal of toner cartridge 100 and imaging unit 200 into and out of image forming device 22.

Sides 108, 109 may each include one or more alignment guides 124 that extend outward from the respective side 108, 109 to assist with mating toner cartridge 100 to imaging unit 200. Alignment guides 124 are received by corresponding guide rails on imaging unit 200 that aid in positioning toner cartridge 100 relative to imaging unit 200. In the example embodiment illustrated, an alignment guide 124 is positioned on an outer side of each end cap 112, 113. In the example embodiment illustrated, each alignment guide 124 includes a post 126 extending outward from a respective side 108, 109 of housing 102. Posts 126 are each spaced above developer roll 120 along front 110 of housing 102. In the embodiment illustrated, an imaginary line 127 that runs through each post 126 is parallel to rotational axis 121 of developer roll 120.

Toner cartridge 100 also includes a drive gear 128 positioned on side 108 of housing 102. In the embodiment illustrated, drive gear 128 mates with and receives rotational force from a corresponding drive gear on imaging unit 200 in order to provide rotational force to developer roll 120 and other rotatable components of toner cartridge 100 for moving toner to developer roll 120 when toner cartridge 100 is installed in image forming device 22. In the embodiment illustrated, drive gear 128 is mounted to a shaft of developer roll 120, coaxial with developer roll 120. In this embodiment, a front portion of drive gear 128 is exposed on the front 110 of housing 102, near bottom 107 of housing 102 and is unobstructed to mate with and receive rotational force from the corresponding drive gear on imaging unit 200. In the embodiment illustrated, drive gear 128 is rotatably connected to a drive train that is positioned between end cap 112 and side wall 114 of housing 102. The drive train aids in transferring rotational force from drive gear 128 to rotatable components of toner cartridge 100, including, for example, to a toner adder roll 130 (FIG. 10) that provides toner from reservoir 104 to developer roll 120 and to one or more toner agitators 132 (FIG. 10) that move toner in reservoir 104 toward toner adder roll 130 and that agitate and mix the toner in reservoir 104. In the example embodiment illustrated, drive gear 128 is formed as a helical gear, but other configurations may be used as desired.

Toner cartridge 100 also includes an electrical connector 140 positioned on side 109 of housing 102 that includes one or more electrical contacts 142 that mate with corresponding electrical contacts in image forming device 22 when toner cartridge 100 is installed in image forming device 22 in order to facilitate communications link 51 between controller 28 of image forming device 22 and processing circuitry 44 of toner cartridge 100.

Toner cartridge 100 also includes one or more electrical contacts 150 positioned on side 109 of housing 102 that mate with corresponding electrical contacts in image forming device 22 when toner cartridge 100 is installed in image forming device 22 in order to facilitate electrical path 57 between one or more imaging components of toner cartridge 100 and power supply 42. For example, in the embodiment illustrated, toner cartridge 100 includes three electrical contacts 150*a*, 150*b*, 150*c* positioned on side 109 of housing 102. In the example embodiment illustrated, at least a portion of electrical contact 150*a* is positioned higher than electrical contact 150*b* and at least a portion of electrical contact 150*b* is positioned lower than electrical contact 150*a*. Similarly, at least a portion of electrical contact 150*b* is positioned higher than electrical contact 150*c* and at least a portion of electrical contact 150*c* is positioned lower than electrical contact 150*b*. In this embodiment, at least a portion of electrical contact 150*a* is positioned rearward, toward rear 111 of housing 102, from electrical contact 150*b* and at least a portion of electrical contact 150*b* is positioned forward, toward front 110 of housing 102, from electrical contact 150*a*, Similarly, at least a portion of electrical contact 150*b* is positioned rearward, toward rear 111 of housing 102, from electrical contact 150*c* and at least a portion of electrical contact 150*c* is positioned forward, toward front 110 of housing 102, from electrical contact 150*b*.

In the example embodiment illustrated, electrical contacts 150*a*, 150*b*, 150*c* are electrically connected to a doctor blade 134 (FIG. 10) of toner cartridge 100, toner adder roll 130 and developer roll 120, respectively, as discussed in greater detail below. In this configuration, doctor blade 134, toner adder roll 130 and developer roll 120 are each electrically charged to a respective predetermined voltage by power supply 42 in order to attract toner from reservoir 112 to toner adder roll 130, to electrostatically transfer toner from toner adder roll 130 to developer roll 120 and from developer roll 120 to the latent image on the surface of a corresponding photoconductive drum of imaging unit 200, and to aid doctor blade 134 in metering the toner on developer roll 120.

In the example embodiment illustrated, electrical contacts 150 are positioned on a projection 154 that projects outward sideways from side 109 of housing 102. In particular, projection 154 extends further outward sideways than an outer side surface 156 of side 109 of housing 102 positioned immediately below projection 154, including a portion of outer side surface 156 that extends from front 110 of housing 102 to rear 111 of housing 102.

With reference to FIGS. 2, 3, 6 and 7, imaging unit 200 includes a housing 202 including a top 206, a bottom 207, first and second sides 208, 209, a front 210 and a rear 211. Front 210 of housing 202 leads during insertion of imaging unit 200 into image forming device 22 and rear 211 trails. In the embodiment illustrated, frame 204 includes a toner cartridge receiving area 205 positioned at rear 211 of housing 202, A handle 212 may be provided on rear 211 of housing 202, e.g., on frame 204, to assist with insertion and removal of toner cartridge 100 and imaging unit 200 into and out of image forming device 22.

In the example embodiment illustrated, imaging unit 200 includes a rotatable photoconductive drum 220 having a rotational axis 221 that runs along a side-to-side dimension 218 of housing 202, from side 208 to side 209. A rear portion of photoconductive drum 220 is open to toner cartridge receiving area 205 of frame 204 for receiving toner from developer roll 120 of toner cartridge 100. A bottom portion of photoconductive drum 220 is exposed from housing 202 on bottom 207 of housing 202. Toner on the outer surface of photoconductive drum 220 is transferred from the bottom portion of the outer surface of photoconductive drum 220 to a media sheet or intermediate transfer member during a print operation. Imaging unit 200 also includes a rotatable charge roll 222 in contact with the outer surface of photoconductive drum 220 that charges the outer surface of photoconductive drum 220 to a predetermined voltage. Imaging unit 200 also includes a waste toner removal system that may include a cleaner blade or roll that removes residual toner from the outer surface of photoconductive drum 220. In the example embodiment illustrated, imaging unit 200 includes a waste toner reservoir 224 positioned at the front 210 of housing 202. Waste toner reservoir 224 stores toner removed from photoconductive drum 220 by the cleaner blade or roll.

Sides 208, 209 may each include one or more alignment guides 226 that extend outward from the respective side 208, 209 to assist with insertion and removal of toner cartridge 100 and imaging unit 200 into and out of image forming device 22. Alignment guides 226 are received by corresponding guide rails in image forming device 22 that aid in positioning toner cartridge 100 and imaging unit 200 relative to image forming device 22. Sides 208, 209 of frame 204 may each include a guide rail 228 that receives a corresponding alignment guide 124 of toner cartridge 100 to aid in positioning toner cartridge 100 relative to imaging unit 200.

Imaging unit 200 also includes a drive coupler 230 positioned on side 208 of housing 202. Drive coupler 230 mates with and receives rotational force from a corresponding drive coupler in image forming device 22 in order to provide rotational force to photoconductive drum 220 when imaging unit 200 is installed in image forming device 22. In the embodiment illustrated, drive coupler 230 is positioned at an axial end of photoconductive drum 220, coaxial with photoconductive drum 220. In this embodiment, an outer axial end of drive coupler 230 is exposed on side 208 of housing 202 and is unobstructed to mate with and receive rotational force from the corresponding drive coupler in image forming device 22. In the example embodiment illustrated, drive coupler 230 is configured to receive rotational force at the outer axial end of drive coupler 230, but other configurations may be used as desired. In some embodiments, charge roll 222 is driven by friction contact between the surfaces of charge roll 222 and photoconductive drum 220. In other embodiments, charge roll 222 is connected to drive coupler 230 by one or more gears.

In the embodiment illustrated, imaging unit 200 also includes a drive gear 232 attached to photoconductive drum 220, axially inboard of drive coupler 230. A portion of drive gear 232 is exposed to toner cartridge receiving area 205 of frame 204 permitting drive gear 128 of toner cartridge 100 to mate with drive gear 232 of imaging unit 200 when toner cartridge 100 is installed on frame 204 of imaging unit 200 to permit the transfer of rotational force received by drive coupler 230 of imaging unit 200 to drive gear 128 of toner cartridge 100 by way of drive gear 232 of imaging unit 200.

Imaging unit 200 also includes an electrical connector 240 positioned on a portion of frame 204 on side 209 of housing 202 that includes one or more electrical contacts 242 that mate with corresponding electrical contacts in image forming device 22 when imaging unit 200 is installed in image forming device 22 in order to facilitate communications link 52 between controller 28 of image forming device 22 and processing circuitry 45 of imaging unit 200.

Imaging unit 200 also includes one or more electrical contacts 250 positioned on side 209 of housing 202 that mate with corresponding electrical contacts in image forming device 22 when imaging unit 200 is installed in image forming device 22 in order to facilitate electrical path 58 between one or more imaging components of imaging unit 200 and power supply 42. For example, in the embodiment illustrated, imaging unit 200 includes two electrical contacts 250*a*, 250*b* positioned on side 209 of housing 202. In the example embodiment illustrated, electrical contacts 250*a*. 250*b* are electrically connected to photoconductive drum 220 and charge roll 222, respectively. In this configuration, photoconductive drum 220 and charge roll 222 are each electrically charged to a respective predetermined voltage by power supply 42 in order to charge photoconductive drum 220 to a desired voltage prior to exposure to laser scan unit 31.

In the example embodiment illustrated, electrical contact 250*a* is formed by an axial end of a shaft 252 that runs through the center of photoconductive drum 220. Shaft 252 is electrically connected to photoconductive drum 220, for example, by an electrically conductive plate that contacts an outer surface of shaft 252 and an inner surface of photoconductive drum 220 as is known in the art. In the embodiment illustrated, electrical contact 250*b* is electrically connected to charge roll 222 by way of an electrical trace that runs from electrical contact 250*b* to an electrically conductive bias spring that, in turn, contacts an electrically conductive bushing that receives a shaft of charge roll 222. The bias spring biases the outer surface of charge roll 222 against the outer surface of photoconductive drum 220 and the bushing aids in positioning charge roll 222 and guiding the rotational movement of charge roll 222.

Figure 8:
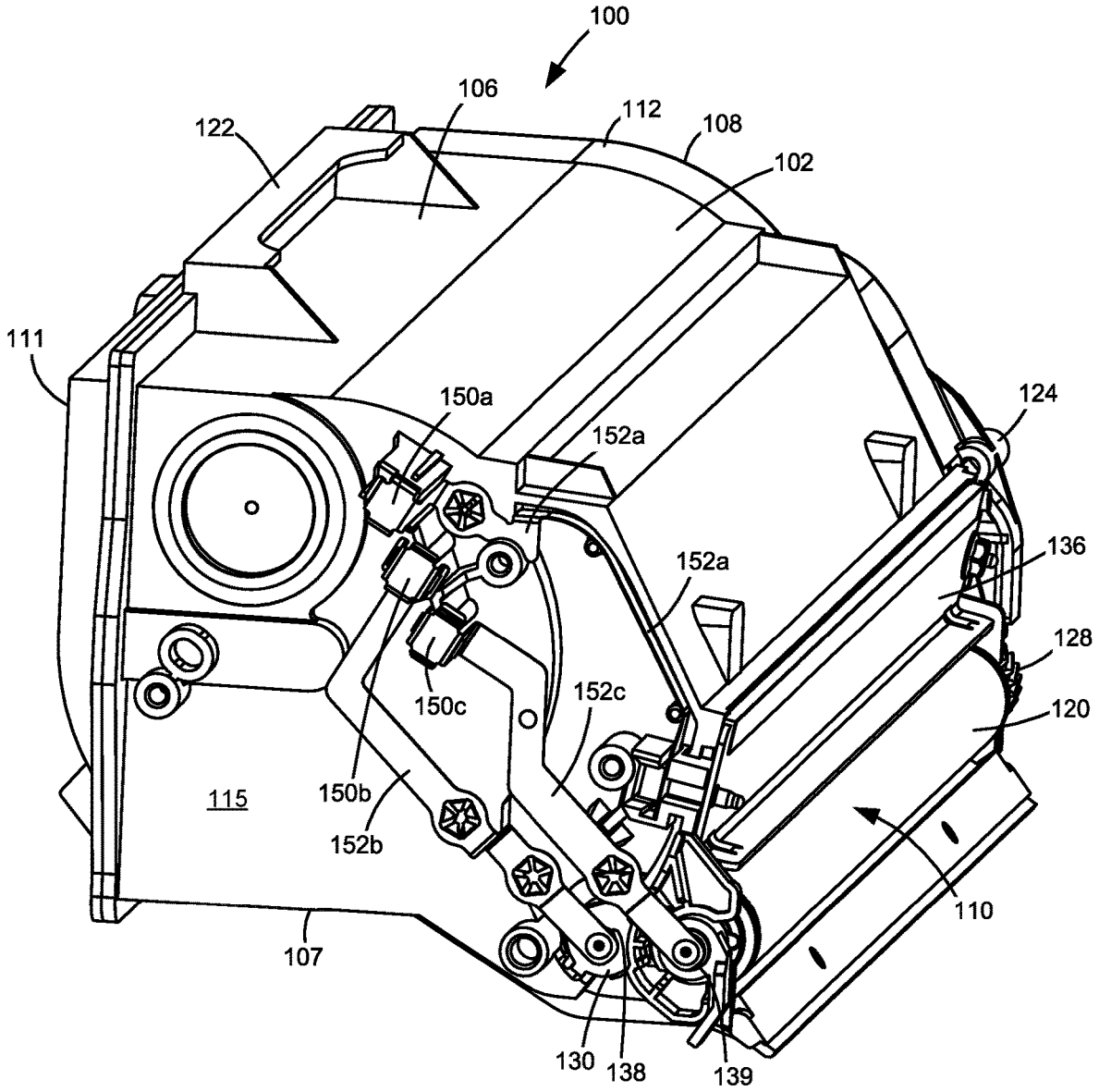
FIG. 8 is a perspective view of the toner cartridge with an end cap omitted illustrating electrical connections of the toner cartridge according to one example embodiment.

FIG. 8 shows the electrical connections between electrical contacts 150*a*, 150*b*, 150*c* and the imaging components of toner cartridge 100 according to one example embodiment. End cap 113 and electrical connector 140 are omitted from FIG. 8 to more clearly illustrate the electrical connections of toner cartridge 100. In the embodiment illustrated, electrical contact 150*a* is electrically connected to doctor blade 134 by an electrical trace 152*a* that runs between end cap 113 and side wall 115 of housing 102 and along an interior portion of front 110 of housing 102 from electrical contact 150*a* to an electrically conductive bracket 136 on front 110 of housing 102 that supports doctor blade 134. In this embodiment, electrical contact 150*b* is electrically connected to toner adder roll 130 by an electrical trace 152*b* that runs between end cap 113 and side wall 115 of housing 102 from electrical contact 150*b* to an axial end of an electrically conductive shaft 138 of toner adder roll 130. Similarly, in this embodiment, electrical contact 150*c* is electrically connected to developer roll 120 by an electrical trace 152*c* that runs between end cap 113 and side wall 115 of housing 102 from electrical contact 150*c* to an axial end of an electrically conductive shaft 139 of developer roll 120.

Figure 9:
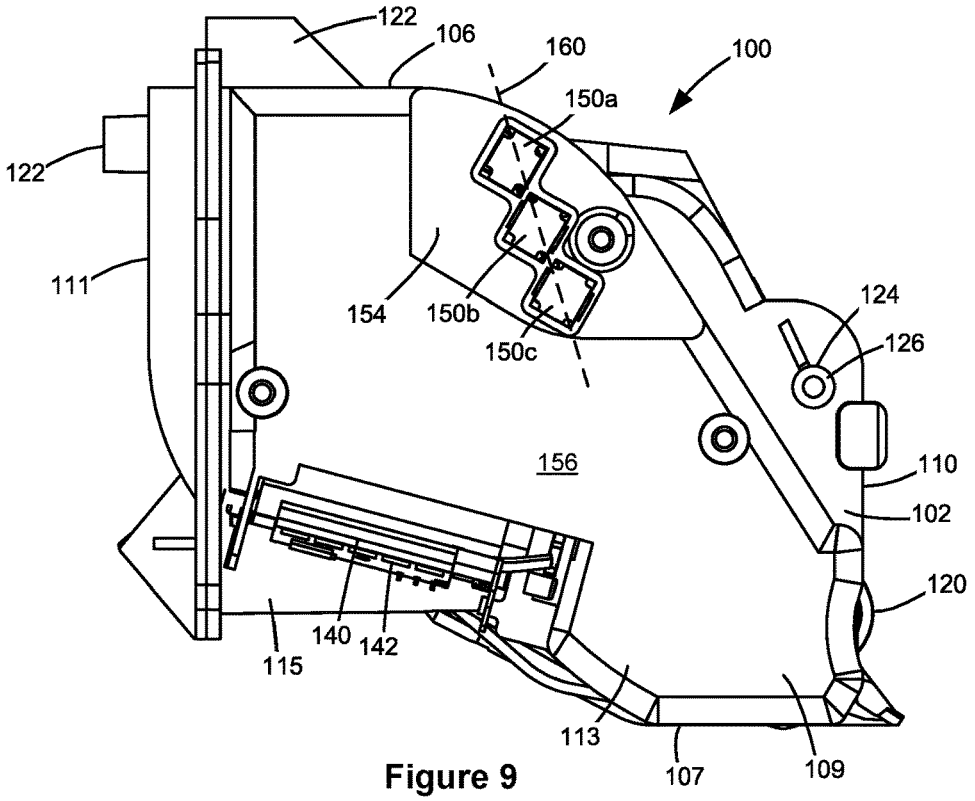
FIG. 9 is a side elevation view of the toner cartridge according to one example embodiment.

FIG. 9 shows the positioning of electrical contacts 150*a*, 150*b*, 150*c* on housing 102 of toner cartridge 100 according to one example embodiment. Electrical contacts 150*a*, 150*b*, 150*c* face outward sideways, away from side 109 of housing 102. In the embodiment illustrated, electrical contacts 150*a*, 150*b*, 150*c* are exposed through one or more openings in end cap 113, e.g., three corresponding openings in end cap 113. In this embodiment, each electrical contact 150*a*, 150*b*. 150*c* may be physically mounted to end cap 113 or to side wall 115 of housing 102. In other embodiments, electrical contacts 150*a*, 150*b*, 150*c* may be positioned on an outer surface of end cap 113 and at least a portion of electrical traces 152*a*, 152*b*, 152*c* may run along the outer surface of end cap 113. In the embodiment illustrated, each electrical contact 150*a*, 150*b*, 150*c* includes a rectangular contact face that faces outward sideways and that has a top edge angled forward toward front 110 of housing 102. However, electrical contacts 150*a*, 150*b*, 150*c* may take many suitable shapes and orientations as desired.

In the embodiment illustrated, electrical contacts 150*a*, 150*b*, 150*c* are linearly arranged such that an imaginary line 160 passes through electrical contacts 150*a*, 150*b*, 150*c*, e.g., through a center of the contact face of each electrical contact 150*a*, 150*b*, 150*c*. In this embodiment, line 160 angles downward in a direction from rear 111 to front 110 of housing 102.

Figure 10:
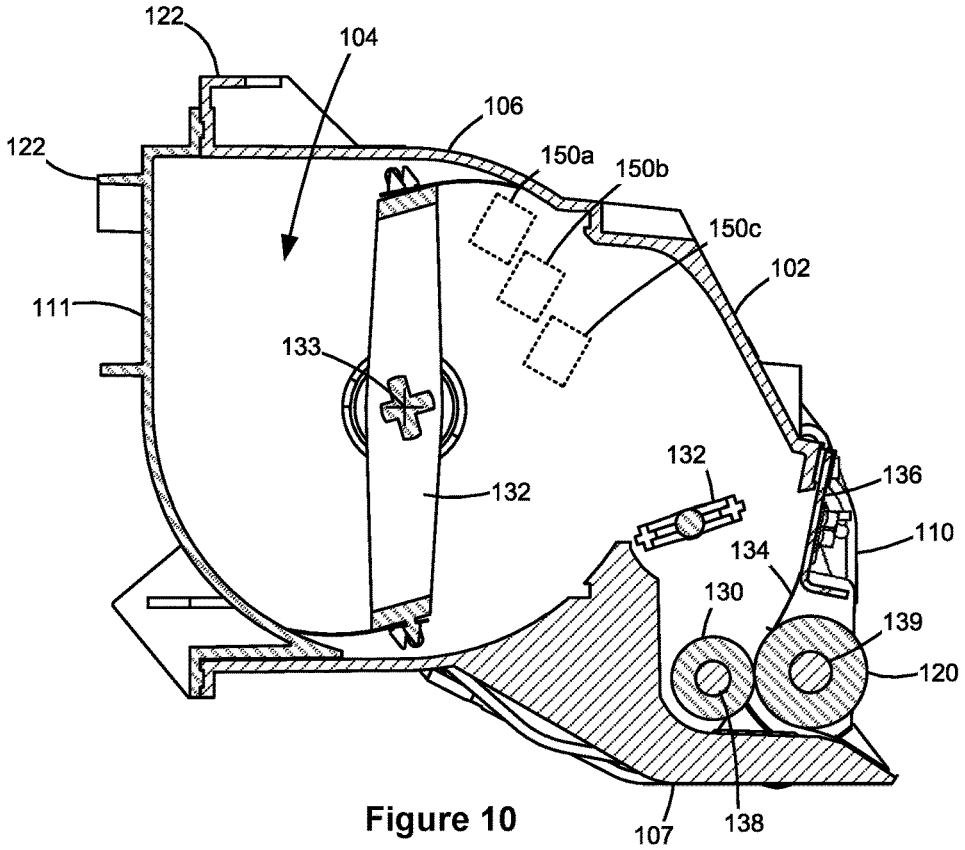
FIG. 10 is a cross-sectional view taken along line 10-10 in FIG. 5 according to one example embodiment.

FIG. 10 is a cross-sectional view of toner cartridge 100 showing the position of electrical contacts 150*a*, 150*b*, 150*c* schematically in broken line. With reference to FIGS. 9 and 10, in the embodiment illustrated, electrical contacts 150*a*, 150*b*, 150*c* are positioned higher than and rearward, toward rear 111 of housing 102, from developer roll 120, toner adder roll 130 and doctor blade 134. Electrical contacts 150*a*, 150*b*, 150*c* are also positioned higher than and rearward, toward rear 111 of housing 102, from drive gear 128 as well as posts 126 of alignment guides 124 in this embodiment. In the embodiment illustrated, electrical contacts 150*a*, 150*b*, 150*c*, are positioned higher than and forward, toward front 110 of housing 102, from electrical contacts 142 of electrical connector 140. In this embodiment, electrical contacts 150*a*, 150*b*, 150*c* are aligned with an upper half of toner reservoir 104 and are positioned higher than and forward, toward front 110 of housing 102, from a rotational axis 133 of a toner agitator 132 that is positioned in a central portion of toner reservoir 104.

The positioning of electrical contacts 150*a*, 150*b*, 150*c* near the top 106 of housing 102 helps protect electrical contacts 150*a*, 150*b*, 150*c* from damage and contamination. Specifically, positioning electrical contacts 150*a*, 150*b*, 150*c* higher than and rearward from developer roll 120 as illustrated helps reduce toner contamination of electrical contacts 150*a*, 150*b*, 150*c*. Positioning electrical contacts 150*a*, 150*b*, 150*c* higher than and forward from electrical contacts 142 of electrical connector 140 as illustrated helps separate electrical path 57 from the electrical path of communications link 51, which has a lower voltage than electrical path 57, in order to reduce the risk of electrical interference and arcing or shorting of electrical path 57 and the electrical path of communications link 51. Positioning electrical contacts 150*a*, 150*b*, 150*c* on projection 154 extending outward sideways from side 109 of housing 102 and higher than and rearward from posts 126 of alignment guides 124 helps clear electrical contacts 150*a*, 150*b*, 150*c* from the loading and unloading path of toner cartridge 100 onto and from imaging unit 200 in order to protect electrical contacts 150*a*, 150*b*, 150*c* from damage.

Figure 11:
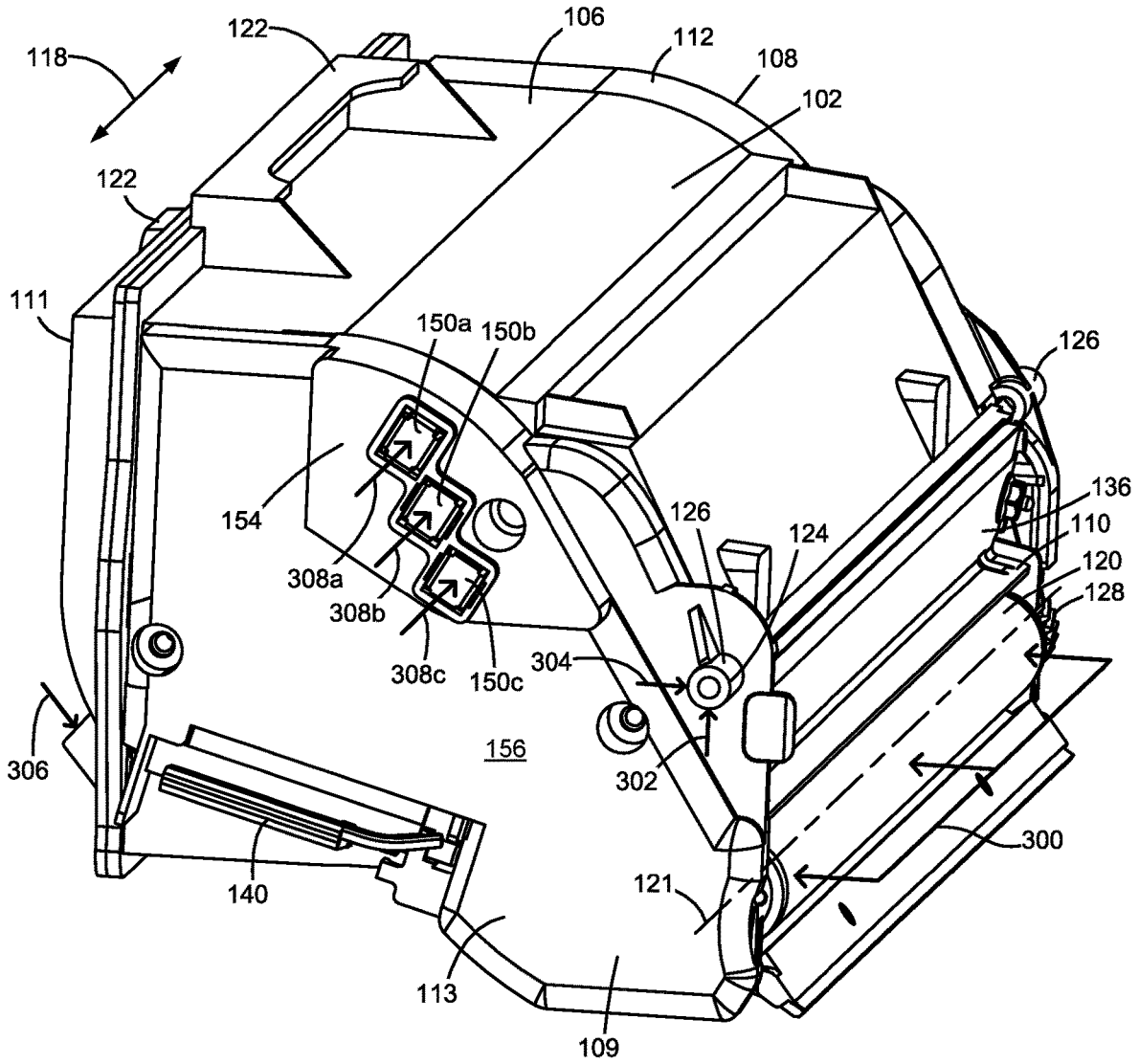
FIG. 11 is a perspective view of the toner cartridge schematically illustrating various forces on the toner cartridge during operation according to one example embodiment.

FIG. 11 shows the directions of various forces on toner cartridge 100 during operation when toner cartridge 100 is mated with imaging unit 200. The forces include a rearward force 300 on developer roll 120 from its contact with photoconductive drum 220 of imaging unit 200. An upward force 302 and a forward force 304 are applied to each post 126 of alignment guide 124 from their contact with corresponding guide rails 228 of imaging unit 200. A downward and forward hold-down force 306 is also applied to toner cartridge 100 by image forming device 22 at rear 111 of housing 102 near each side 108, 109 of housing 102, FIG. 11 also shows forces 308*a*, 308*b*, 308*c* applied to electrical contacts 150*a*, 150*b*, 150*c* by the corresponding electrical contacts in image forming device 22. Forces 308*a*, 308*b*, 308*c* are parallel to side-to-side dimension 118 of housing 102 and rotational axis 121 of developer roll 120. As shown in FIG. 11, forces 308*a*, 308*b*, 308*c* are orthogonal to forces 300, 302, 304 and 306 on toner cartridge 100 so as not to unseat developer roll 120 from photoconductive drum 220 which could result in print defects. Forces 308*a*, 308*b*, 308*c* also help locate toner cartridge 100 relative to imaging unit 200 along side-to-side dimension 118 of housing 102 and rotational axis 121 of developer roll 120.

Although the example embodiment illustrated includes three electrical contacts 150*a*, 150*b*, 150*c* positioned on toner cartridge 100 and electrically connected to imaging components of toner cartridge 100, toner cartridge 100 may include more or fewer than three electrical contacts as desired depending on the number of imaging components of toner cartridge 100 requiring distinct voltages.

Although the example embodiment discussed above includes a pair of replaceable units in the form of a toner cartridge 100 that includes the main toner supply for the image forming device and the developer unit and an imaging unit 200 that includes the photoconductor unit for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device, the developer unit and the photoconductor unit are provided in a single replaceable unit. Other configurations may be used as desired.

Further, it will be appreciated that the architecture and shape of toner cartridge 100 and imaging unit 200 illustrated is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for use in an image forming device, comprising:

a housing having a top, a bottom, a front and a rear positioned between a first side and a second side of the housing, the front of the housing is positioned to lead during insertion of the toner cartridge into the image forming device, the housing has a reservoir for holding toner;

an outlet in fluid communication with the reservoir positioned on the front of the housing for exiting toner from the toner cartridge; and a first electrical contact, a second electrical contact and a third electrical contact positioned on the first side of the housing for contacting a first corresponding electrical contact in the image forming device, a second corresponding electrical contact in the image forming device and a third corresponding electrical contact in the image forming device, each of the first, second and third electrical contacts of the toner cartridge is electrically connected to a respective imaging component positioned on the toner cartridge, each of the first, second and third electrical contacts of the toner cartridge includes a rectangular contact face that faces outward sideways away from the first side of the housing and that has a top edge angled forward toward the front of the housing, wherein the first, second and third electrical contacts of the toner cartridge are positioned such that an imaginary line that angles downward in a direction from the rear of the housing toward the front of the housing passes through the first, second and third electrical contacts of the toner cartridge.

2. The toner cartridge of claim 1, wherein at least a portion of the first electrical contact of the toner cartridge is positioned higher than the second electrical contact of the toner cartridge and closer to the rear of the housing than the second electrical contact of the toner cartridge is to the rear of the housing, at least a portion of the second electrical contact of the toner cartridge is positioned lower than the first electrical contact of the toner cartridge and closer to the front of the housing than the first electrical contact of the toner cartridge is to the front of the housing, at least a portion of the second electrical contact of the toner cartridge is positioned higher than the third electrical contact of the toner cartridge and closer to the rear of the housing than the third electrical contact of the toner cartridge is to the rear of the housing, at least a portion of the third electrical contact of the toner cartridge is positioned lower than the second electrical contact of the toner cartridge and closer to the front of the housing than the second electrical contact of the toner cartridge is to the front of the housing.

3. The toner cartridge of claim 1, wherein each of the first, second and third electrical contacts of the toner cartridge is positioned on a projection that projects outward sideways from the first side of the housing, the projection extends further outward sideways than an outer side surface of the first side of the housing that is positioned below the projection and that extends from the front of the housing to the rear of the housing.

4. The toner cartridge of claim 1, further comprising a developer roll rotatably positioned on the toner cartridge, wherein the outlet includes a portion of an outer surface of the developer roll exposed along the front of the housing for supplying toner from the reservoir to a corresponding photoconductive drum, wherein one of the first, second and third electrical contacts of the toner cartridge is electrically connected to the developer roll.

5. The toner cartridge of claim 4, wherein at least a portion of each of the first, second and third electrical contacts of the toner cartridge is positioned higher than the developer roll and is positioned closer to the rear of the housing than the developer roll is to the rear of the housing.

6. The toner cartridge of claim 1, further comprising a first alignment guide extending outward from the first side of the housing and a second alignment guide extending outward from the second side of the housing for positioning the toner cartridge, wherein at least a portion of each of the first, second and third electrical contacts is positioned higher than the first and second alignment guides and is positioned closer to the rear of the housing than the first and second alignment guides are to the rear of the housing.

7. The toner cartridge of claim 1, further comprising a fourth electrical contact on the first side of the housing for contacting a fourth corresponding electrical contact in the image forming device, the fourth electrical contact of the toner cartridge is electrically connected to processing circuitry mounted on the toner cartridge, wherein at least a portion of each of the first, second and third electrical contacts of the toner cartridge is positioned higher than the fourth electrical contact of the toner cartridge and is positioned closer to the front of the housing than the fourth electrical contact of the toner cartridge is to the front of the housing.

8. A toner cartridge for use in an image forming device, comprising:

a housing having a top, a bottom, a front and a rear positioned between a first side and a second side of the housing, the front of the housing is positioned to lead during insertion of the toner cartridge into the image forming device, the housing has a reservoir for holding toner;

an outlet in fluid communication with the reservoir positioned on the front of the housing for exiting toner from the toner cartridge; and a first electrical contact, a second electrical contact and a third electrical contact positioned on the first side of the housing for contacting a first corresponding electrical contact in the image forming device, a second corresponding electrical contact in the image forming device and a third corresponding electrical contact in the image forming device, each of the first, second and third electrical contacts of the toner cartridge is electrically connected to a respective imaging component positioned on the toner cartridge, each of the first, second and third electrical contacts of the toner cartridge includes a rectangular contact face that faces outward sideways away from the first side of the housing and that has a top edge angled forward toward the front of the housing, wherein at least a portion of the first electrical contact of the toner cartridge is positioned higher than the second electrical contact of the toner cartridge and closer to the rear of the housing than the second electrical contact of the toner cartridge is to the rear of the housing, at least a portion of the second electrical contact of the toner cartridge is positioned lower than the first electrical contact of the toner cartridge and closer to the front of the housing than the first electrical contact of the toner cartridge is to the front of the housing, at least a portion of the second electrical contact of the toner cartridge is positioned higher than the third electrical contact of the toner cartridge and closer to the rear of the housing than the third electrical contact of the toner cartridge is to the rear of the housing, at least a portion of the third electrical contact of the toner cartridge is positioned lower than the second electrical contact of the toner cartridge and closer to the front of the housing than the second electrical contact of the toner cartridge is to the front of the housing.

9. The toner cartridge of claim 8, wherein each of the first, second and third electrical contacts of the toner cartridge is positioned on a projection that projects outward sideways from the first side of the housing, the projection extends further outward sideways than an outer side surface of the first side of the housing that is positioned below the projection and that extends from the front of the housing to the rear of the housing.

10. The toner cartridge of claim 8, further comprising a developer roll rotatably positioned on the toner cartridge, wherein the outlet includes a portion of an outer surface of the developer roll exposed along the front of the housing for supplying toner from the reservoir to a corresponding photoconductive drum, wherein one of the first, second and third electrical contacts of the toner cartridge is electrically connected to the developer roll.

11. The toner cartridge of claim 10, wherein at least a portion of each of the first, second and third electrical contacts of the toner cartridge is positioned higher than the developer roll and is positioned closer to the rear of the housing than the developer roll is to the rear of the housing.

12. The toner cartridge of claim 8, further comprising a first alignment guide extending outward from the first side of the housing and a second alignment guide extending outward from the second side of the housing for positioning the toner cartridge, wherein at least a portion of each of the first, second and third electrical contacts is positioned higher than the first and second alignment guides and is positioned closer to the rear of the housing than the first and second alignment guides are to the rear of the housing.

13. The toner cartridge of claim 8, further comprising a fourth electrical contact on the first side of the housing for contacting a fourth corresponding electrical contact in the image forming device, the fourth electrical contact of the toner cartridge is electrically connected to processing circuitry mounted on the toner cartridge, wherein at least a portion of each of the first, second and third electrical contacts of the toner cartridge is positioned higher than the fourth electrical contact of the toner cartridge and is positioned closer to the front of the housing than the fourth electrical contact of the toner cartridge is to the front of the housing.

* * * * *